US005645088A

United States Patent [19]

Olovson

[11] Patent Number: 5,645,088

[45] Date of Patent: Jul. 8, 1997

[54] DEVICE FOR TREATING SMOKE ADDICTION

[76] Inventor: Gudmar Olovson, 64, rue Saint-Charles, F-75015, Paris, France

[21] Appl. No.: 244,908

[22] PCT Filed: Nov. 21, 1992

[86] PCT No.: PCT/SE92/00779

§ 371 Date: Dec. 21, 1994

§ 102(e) Date: Dec. 21, 1994

[87] PCT Pub. No.: WO93/09687

PCT Pub. Date: May 27, 1993

[30] Foreign Application Priority Data

Nov. 14, 1991 [SE] Sweden ..... 91 03366

[51] Int. Cl.[6] ..... A24F 47/00

[52] U.S. Cl. ..... 131/270; 128/859

[58] Field of Search ..... 131/270–273; 424/439, 440, 464, 467, 197.1; 514/813; 128/859–863

[56] References Cited

U.S. PATENT DOCUMENTS

| | | | |
|---|---|---|---|
| 2,424,533 | 7/1947 | Faires | 128/861 X |
| 3,113,076 | 12/1963 | Jacobs | 424/467 |
| 4,744,971 | 10/1988 | Vieten . | |
| 4,793,366 | 12/1988 | Hill . | |
| 5,035,252 | 7/1991 | Mondre | 131/270 X |
| 5,055,478 | 10/1991 | Cooper et al. | 424/440 X |
| 5,108,756 | 4/1992 | Curatolo | 424/467 X |
| 5,229,132 | 7/1993 | Grimberg | 424/464 X |

FOREIGN PATENT DOCUMENTS

WO92/02152 2/1992 WIPO .

*Primary Examiner*—Jennifer Bahr

*Attorney, Agent, or Firm*—Burns, Doane, Swecker & Mathis, L.L.P.

[57] ABSTRACT

A device for treating smoking addiction is adapted to be held between the frontal teeth surfaces and inner surface of the lips of a user has a central part and a peripheral part. The central part has at least one hole and is made of plastic or rubber material. The peripheral part is made of a saliva-dissolvable material. The user draws air through the hole in the central part such that the inhalation essentially mimics draw on a smoking article.

6 Claims, 1 Drawing Sheet

DEVICE FOR TREATING SMOKE ADDICTION

TECHNICAL FIELD

The present invention relates to a device which is intended and adapted to be enclosed by a space defined between the frontal surfaces of the teeth and the inner surfaces of the lips of a user.

The inventive device is intended to assist people who suffer from a smoking or tobacco dependency and who wish consciously to take measures to overcome their smoking dependency.

More specifically, the inventive device is intended to function as an auxiliary for people who do not have sufficient willpower to stop smoking immediately, but who wish to reduce their smoking habit successively, at their own pace.

KNOWN PRIOR ART

Ingrained smokers who wish to overcome a pronounced craving to smoke have at least three mutually independent habits and cravings to overcome:

Habit of Movement

When smoking, the smoker will move his/her hands in a pattern which has become habitual and which is therefore normally deeply rooted. Normally, there is a certain ceremonial touch over the movement pattern of the hands of a smoker as he/she smokes, for instance the manner in which a cigarette, cigar, pipe or like device is held and moved.

The Desire to Smoke

In the act of smoking, the air or gas which passes through the cigarette, etc., as the smoker draws on the cigarette meets a certain resistance, the magnitude of which depends on the flow rate of the inhalation air. Consequently, there exists an ingrained feeling that the inhalation air does not constantly obtain free passage through the pharynx and down into the lungs.

Craving for Nicotine

Finally, as a result of the smoke generated and the inhalation of this smoke, there is delivered to the smoker a highly habit-forming, stimulating poison in the form of nicotine.

There are known to the art several different devices and proposals for enabling a person suffering from a tobacco dependency to reduce his/her tobacco consumption successively as opposed to stopping smoking completely.

For instance, various methods have been proposed for successively reducing the craving for nicotine.

SUMMARY OF THE INVENTION

TECHNICAL PROBLEM

When considering the present standpoint of techniques, as described above, it will be seen that a technical problem exists in providing a device which in a first withdrawal stage provides a possibility of overcoming solely the aforesaid movement habits, and also a possibility of completely satisfying the desire to smoke and the craving for nicotine.

It will also be seen that a technical problem resides in the provision of a device which, after having overcome the movement habit, is able to provide a possibility of overcoming the craving for nicotine, either immediately or successively over a period of time, but while still satisfying the desire to smoke during the whole of the treatment period.

It will also be seen from the present state of techniques that a technical problem resides in the ability to realize the significance of providing a device which can be held in the mouth and which is so configured that an airflow drawn therethrough (inhalation) will meet with a resistance which corresponds to or essentially corresponds to the resistance applicable to the airflow through a cigarette, cigar, pipe or the like at a flow rate which is applicable to normal smoking.

It will also be seen that a technical problem is one of being able to realize the significance of configuring the device so that it can be enclosed in a space defined by the user between frontal surfaces of the teeth and the inner surfaces of the lips.

Another technical problem in this respect is one of being able to realize the significance of configuring said device with a central part and by forming a peripheral part from a saliva-dissolved material, or by constructing the device as a whole from a saliva-dissolved material, i.e. the device exists in tablet form.

It must also be considered a technical problem to realize the significance of selecting the peripheral part from a material which is more dissolved readily by saliva than the central part.

Another technical problem is one of realizing the significance of including in the saliva-dissolved material an adapted proportion of nicotine such that the devices or tablets used will have varying proportions of nicotine and that a successive transition to smaller and smaller proportions of nicotine is required in weaning process.

SOLUTION

The present invention relates to a device which is intended and adapted to be enclosed in a space defined between the frontal surfaces of the teeth and the inner surfaces of the lips of a user.

In accordance with the invention, the device is provided in a central region which contains one or more holes whose cross-section is adapted so that the airflow drawn in through the device (inhalation) will meet with a resistance which corresponds to or essentially corresponds to the resistance met by the airflow through a cigarette, cigar, pipe or like device, where the flow rate is adapted to the flow rate applicable to normal smoking.

According to proposed embodiments that fall within the scope of the present invention, the perforated central part of the device consists of a plastic material, rubber material or like material, and a peripheral part which surrounds or partially embraces the central part consists of a material which is dissolved by the saliva of the user.

It is also proposed that the central part and the peripheral part which surrounds the central part either completely or partially, are comprised of a saliva-dissolved material.

According to another proposal, the peripheral part is made from a material which is more readily dissolved by saliva than the material from which the central part is made.

Finally, it is suggested that the saliva-dissolved material will contain an adapted proportion of nicotine.

ADVANTAGES

Those advantages primarily afforded by an inventive device when used to cure or wean smokers from their tobacco or smoking dependency reside in the creation of conditions in which, in a first step, the smoker is able to overcome the movement habits of his/her arms and hands and, in a second step, successively reduce the craving for nicotine and finally, in a last step, to overcome the smoker's desire to smoke.

BRIEF DESCRIPTION OF THE DRAWING

A number of embodiments at present proposed and illustrating the significant characteristic features of the present invention will now be described in more detail with reference to the accompanying drawing, in which.

DESCRIPTION OF EMBODIMENTS AT PRESENT PREFERRED

Figure 1:
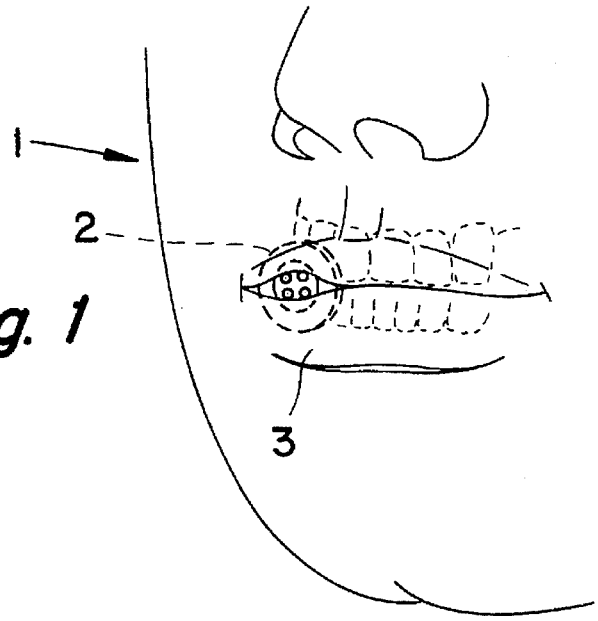
FIG. 1 is a front view of a person holding an inventive device in a space defined between the frontal surfaces of the teeth and the inner surfaces of the lips.

FIG. 1 illustrates the face of a person 1 holding an inventive device 2 in a space 3 defined between the frontal surfaces of the teeth of the carrier or user and the inner surfaces of the lips thereof.

Figure 2:
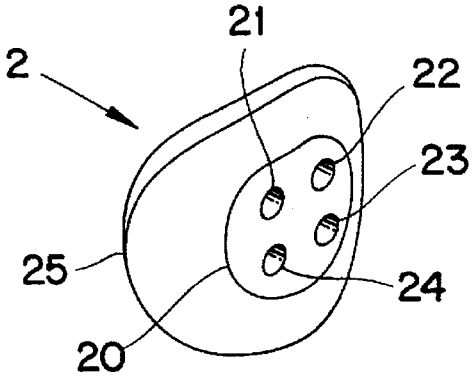
FIG. 2 is a perspective view of a first embodiment of the inventive device.

It is assumed that the device 2 in FIG. 1 is identical with the device illustrated in FIG. 2, and it will be seen from FIG. 2 that the device is provided with one or more holes in a central region 20, these holes being four in number and referenced 21, 22, 23, 24. The common cross-section of the holes is adapted so that when inhaling, the airflow drawn through the device will meet with a resistance which corresponds to, or essentially corresponds to, an air resistance that is applicable to the airflow through a cigarette, a cigar, a pipe or like smoking device, and where the air resistance thus relates to a flow rate through the cigarette or the like applicable to normal smoking.

It will be seen from FIG. 2 that the central part containing the holes 21–24 is comprised of a plastic material, a rubber material or like material, and that the central part 20 is surrounded by a peripheral part 25 comprised of a saliva-dissolved material.

This material may comprise a gel-forming material, sugar and natural aromatic substances. and may optionally also include an adapted proportion of nicotine.

The proportion of nicotine contained by the central part 20 may differ with different batches of devices, so as to enable the craving for nicotine to be gradually reduced, by beginning with a nicotine proportion that corresponds to the general nicotine content of a cigarette. cigar. pipe or the like and reducing successively to an insignificant nicotine content or to no nicotine content at all.

Figure 3:
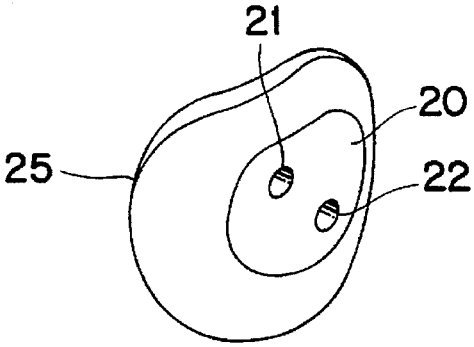
FIG. 3 illustrates a second embodiment of the inventive device.

In the embodiment illustrated in FIG. 3. the central part 20 and the totally or partially surrounding peripheral part 25 are produced in one piece and consist of a saliva-dissolved material.

The device illustrated in FIG. 3 has two penetrating holes 21, 22 which are dimensioned similarly to the four holes of the FIG. 2 embodiment.

In the FIG. 3 embodiment, the peripheral part 25 of the device is made from a material which is dissolved more readily by saliva than the material from which the central part is made, which means that when the device has been used to satisfy the desire for a smoke, the remaining part of the device, essentially the central part 20, can serve as a conventional throat tablet.

Also lying within the scope of the invention is an embodiment in which an adapted proportion of nicotine is mixed solely in the peripheral part 25, where a higher concentration of nicotine is mixed in the peripheral part 25 and in the central part 20, or where equal proportions of nicotine are mixed in both the peripheral and the central parts.

Figure 4:
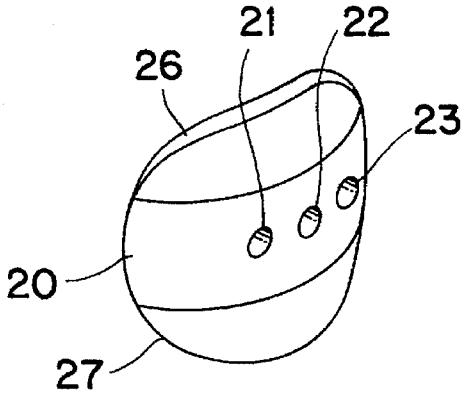
FIG. 4 illustrates a third embodiment of the device.

Finally, FIG. 4 illustrates an embodiment having a more elliptical shape and comprising a central part 20 provided with three holes 21, 22 and 23.

The central part 20 may be formed in accordance with the prerequisites illustrated in FIG. 2, although it will be noticed that in the FIG. 4 embodiment a part 26 is partially surround the central part and a further part 27 also partially surrounds the central part 20, said partially surrounding parts 26 and 27 possibly comprising material which corresponds to the material described and illustrated with reference to FIGS. 2 and 3.

It is known that the air resistance of a cigarette decreases as the cigarette becomes shorter, i.e. consumed. This feature can also be afforded by the inventive device, by permitting the holes to increase slightly in diameter during a "smoking sequence".

This can be achieved by coating the inside of each hole with a thin layer of saliva-dissolved material, or in some other way.

It will be understood that the invention is not restricted to the aforedescribed and illustrated embodiments thereof and that modifications can be made within the scope of the inventive concept as defined in the following claims.

I claim:

1. A device adapted to be held enclosed in the space between the frontal surfaces of the teeth and the inner surface of the lips of a user, said device having a central part and a peripheral part, said central part being provided with at least one hole having a cross-section specifically sized so that airflow drawn through said at least one hole meets with a resistance that essentially corresponds to air resistance met by airflow through a smokable device, said central part being made of one of a plastic material and rubber material, said peripheral part being made of a saliva-dissolvable material.

2. A device according to claim 1, wherein said peripheral part completely surrounds the central part.

3. A device according to claim 1, wherein said central part extends to peripheral regions of the device, and said peripheral part partially surrounds the central part.

4. A device according to claim 1, wherein said saliva-dissolvable material contains nicotine.

5. A device according to claim 1, wherein said central part is provided with a plurality of through holes.

6. A method of weaning an individual from smoking dependency associated with smoking a smokable device, comprising:

positioning between the frontal surfaces of an individual's teeth and the inner surfaces of the individual's lips a device having at least one through hole possessing a cross-section specifically adapted so that airflow drawn through the at least one hole upon inhaling by the individual meets with a resistance that essentially corresponds to air resistance met by airflow through the smokable device; and inhaling to draw air through the at least one hole in the device.

* * * * *